US011097819B1

(12) United States Patent
Kasper et al.

(10) Patent No.: US 11,097,819 B1
(45) Date of Patent: Aug. 24, 2021

(54) INVERTIBLE PERSONAL WATERCRAFT WITH VIEWING WINDOW

(71) Applicants: David Lee Kasper, Dexter, MI (US); Rachael Batcheler Kasper, Dexter, MI (US)

(72) Inventors: David Lee Kasper, Dexter, MI (US); Rachael Batcheler Kasper, Dexter, MI (US)

( * ) Notice: Subject to any disclaimer, the term of this patent is extended or adjusted under 35 U.S.C. 154(b) by 352 days.

(21) Appl. No.: 16/338,577

(22) PCT Filed: Dec. 22, 2017

(86) PCT No.: PCT/US2017/068106

§ 371 (c)(1),
(2) Date: Apr. 1, 2019

(87) PCT Pub. No.: WO2018/119355

PCT Pub. Date: Jun. 28, 2018

Related U.S. Application Data

(63) Continuation-in-part of application No. 29/588,923, filed on Dec. 23, 2016, now Pat. No. Des. 828,473.

(60) Provisional application No. 62/461,468, filed on Feb. 21, 2017.

(51) Int. Cl.
*B63C 11/49* (2006.01)
*B63B 19/02* (2006.01)

(52) U.S. Cl.
CPC ..... *B63C 11/49* (2013.01); *B63B 19/02* (2013.01)

(58) Field of Classification Search
CPC ..... B63C 11/49; B63B 19/02
See application file for complete search history.

(56) References Cited

U.S. PATENT DOCUMENTS 3,081,726 A * 3/1963 Betts ..... B63B 32/20 114/66
3,619,042 A 11/1971 Lazar
4,145,783 A 3/1979 Rhodes
5,672,082 A 9/1997 Binder
D828,473 S * 9/2018 Kasper ..... D21/803
(Continued)

FOREIGN PATENT DOCUMENTS

GB 2391956 A 2/2004

*Primary Examiner* — Stephen P Avila
(74) *Attorney, Agent, or Firm* — Endurance Law Group PLC

(57) ABSTRACT

An inflatable hand-held snorkeling float supports a see-through underwater viewing module having a top glass and a bottom glass joined by a collapsible sidewall. A pneumatic chamber surrounds the viewing module. The chamber has a top deck and a bottom deck symmetrically pitched about a central longitudinal axis to form a wedge-shape having an included angle between about 5° and 15°. The top and bottom glasses are also wedge-shaped symmetrically about the longitudinal axis. Handles extend from the sides of the chamber, and are generally centered along a central transverse axis. An optional accessory mount may be affixed to one of the decks adjacent the bow. The accessory mount can be configured with a pair of dedicated connection pads to hold a dive flag and a camera, or two cameras, etc. The configuration of the float provides flotation symmetry when roll-inverted but flotation asymmetry when pitch-inverted.

20 Claims, 10 Drawing Sheets

(56) References Cited

U.S. PATENT DOCUMENTS

2012/0156951 A1* 6/2012 Segev ..... B63C 11/49
441/129
2016/0096598 A1 4/2016 Harkrider

* cited by examiner

INVERTIBLE PERSONAL WATERCRAFT WITH VIEWING WINDOW

CROSS REFERENCE TO RELATED APPLICATIONS

This application claims priority to U.S. Design patent application No. 29/588,923 filed Dec. 23, 2016 and to U.S. Provisional Patent Application No. 62/461,468 filed Feb. 21, 2017, the entire disclosures of which are hereby incorporated by reference and relied upon.

BACKGROUND OF THE INVENTION

Field of the Invention

The invention relates generally to floating structures with underwater viewing devices, and more particularly to inflatable hand-held flotation craft having an integrated underwater viewing window.

Description of Related Art

Viewing the underwater world has been a challenge throughout time because the human eye is incapable of focused vision in water without a stable, non-glare airspace between the eye and the body of water. Unfortunately, merely positioning one's head near the water surface does not render a clear view of what lies beneath due to natural light reflection as well as water ripples or waves. As a result, trying to observe the water underworld while floating at the water surface is not possible absent the use of goggles or a mask, or a specially-designed viewing screen.

Although goggles and snorkeling/scuba masks are now commonplace, each providing a stable, non-glare airspace so that a person can see clearly underwater, not everyone has access to such apparatus. Even when goggles or masks are available to borrow or rent, the potential for disease transmission causes many people to reject the offer. In addition to these equipment access issues, not all people have the ability to wear goggles or snorkeling/scuba masks. For example, many people that wish to see what is underwater are physically and/or psychologically incapable of, or resistant to, partially submerging their head below water as is required to use goggles or a mask for underwater viewing.

To avoid these issues associated with wearable underwater vision apparatus (i.e., goggles and snorkeling/scuba masks), the prior art has proposed various non-wearable apparatus to observe the underwater while floating on water. Such types of apparatus are designed so that an underwater viewing device is permanently fixed to a boat or raft or some form of personal swim craft. Examples of these types of devices may be found in: U.S. Pat. No. 4,925,417 to Warren issued May 15, 1990; U.S. Pat. No. 5,476,955 to Hackett issued Dec. 19, 1995; U.S. Pat. No. 6,241,569 to Harkrider issued Jun. 5, 2001; and U.S. Pat. No. 7,927,164 to Kuchler, issued Apr. 19, 2011. All of these prior art references are hereby incorporated by reference and relied upon.

One notable example is U.S. Pat. No. 6,572,424 to Harkrider, issued Jun. 3, 2003. Harkrider '424 is directed toward a personal swim craft fitted with a liquid-filled viewing area that is fixed within the craft. The viewing area is formed by a walled cavity, sealed at its upper and lower openings with transparent panes, located near the fore end of the swim craft. The void between the transparent panes is filled with water via a pluggable vent. The upper pane of the viewing area is slanted aft to allow extraneous water to run off into scuppers or vertical vents adjacent to the aft perimeter edge of the upper pane. The lower pane is flat horizontal. The vents allow the escape of air bubbles that may become trapped below the outer surface of the lower transparent pane. When the craft is floating on the water, the flat bottom transparent pane is submerged and the water contained within the viewing area cavity forms a column of transparent liquid that effectively "rises above" the surface level of the body of water. The user lies prone on the craft, with their forehead resting on the head support, so that their eyes are directly over the viewing window.

Another example, which is illustrative of the current state of the art, includes the personal inflatable watercraft with viewing window formerly marketed under the brand name "Jelly Fish™" by iSnorkel.com of Dexter, Mich. The Jelly Fish™ was a small, hand-held viewing window that was ideally suited to use in connection with highly buoyant salt water settings, or fresh water conditions when the user also wore an auxiliary personal flotation device (PFD) like a life jacket. Especially for larger-bodied users, the Jelly Fish™ was not conducive to fresh-water applications unless buoyancy was supplemented by a PFD, a wetsuit, or the like. The Jelly Fish™ had one handle, on the top bow/fore that was not well-suited for one-handed use in water due to the tendency to cause tipping under pressure.

Recording video (videography) has become a popular practice during outdoor adventure activities, such as hiking, skydiving and skiing. Practically speaking, it is difficult to hold a video camera while recording video during many outdoor adventure type sporting activities. To address this issue, some camera makers (e.g. GoPro™) provide various mounting methods for hands-free operation of the camera. For example, some hands-free mounting options include helmet mounts, body mounts, and wrist strap mounts. Such wearable mounts have proven to be convenient and relatively secure in terms of protecting the camera against damage or loss during the activity.

However, video-recording remains somewhat difficult to implement in certain water sports, such as flotation-based snorkeling. Flotation-based snorkeling consists of floating on the water surface in an inflatable craft, often in a large body of water like the ocean or a freshwater lake or a swimming pool. Recording video and images while floating has been difficult for a user because of the constant movement and also because practically every surface of an inflatable craft is flexible and yields under the load (mass) of a video camera. In other words, shaking movement of a video camera is compounded in the case of flotation snorkeling by the bobbling movement of the craft plus the spongy nature of the available mounting surfaces. Furthermore, when a person is involved in flotation-based snorkeling they may need to steer themselves with a swimming hand motion at times, which could make holding a video camera awkward or limiting.

In addition to video cameras, there is also a need for providing a convenient method to store items that could be damaged by water and/or easily lost during the course of a water-sports activity like flotation snorkeling. For example, identity documents and paper money can be damaged by water. Car keys and room keys and credit cards can be easily lost while rafting and snorkeling. Water-proof containers, sometimes called "dry boxes" have been developed for this purpose. However, there is not always a convenient method to secure a dry box to an inflatable craft. And when a method of securing the dry box is available, rarely is the dry box in a convenient and easily accessed location for the user. Most inflatable water craft currently offer little or no location for such placement, other than on the body of the user. Placing a dry box or video camera in the pocket of a bathing suit is naturally cumbersome and uncomfortable.

In addition to video cameras and dry boxes, flotation snorkelers often need a convenient way to secure other accessories in a readily accessible manner. For example, illumination devices and cellular phones and GPS devices are among the many other types of accessories commonly carried into the water by snorkelers.

Turning to another issue that is peculiar to the sport of flotation snorkeling, a growing number of states and jurisdictions are requiring snorkelers and skin divers who venture into a navigable body of water (i.e., if they are wearing a mask and snorkel to look underwater, thus making the person a "skin diver"), to display a recreational "dive flag" (See Florida Dive Flag Law, Florida Statutes 327.331). The dive flag lets nearby vessels know that they should keep well clear and maintain a slow speed in the vicinity. In North America, a dive flag is conventionally red with a white stripe running diagonally from the upper left corner to the lower right corner. Finding a suitable location and method to attach a dive flag to an inflatable raft may be difficult. A related issue involves the use of signaling flags on inflatable crafts that are deployed in groups, such as from water-sport outfitters, cruise ships tour operators, and coastal resorts to name but a few. In some cases, a business that manages group activities will provide rental equipment for numerous different groups that are all deployed simultaneously. It may be desirable to maintain visual awareness of which equipment rentals are associated with each group. Unique flags (e.g., color-coded, symbols, etc.) could be used to distinguish the various groups. However, finding a suitable location and method to attach a flag to an inflatable craft has proven difficult. And still another related issue involves advertising opportunities for businesses that cater to the clientele of water-sport outfitters, cruise ships, coastal resorts and the like. For example, a local retailer or eatery, or a major beverage company or clothing brand, may wish to target advertisements to people that rent flotation snorkeling equipment. There is, unfortunately, not a convenient way to use flags and other aerial features in connection with these marking and advertising ambitions within the flotation snorkeling industry.

There is therefore a need for an inflatable style of personal underwater viewing apparatus that is convenient to transport, that is robust enough to enjoy a long service life, and that is readily adaptable to situations where the user may or may not be wearing a personal flotation device (PFD) or wetsuit, and that can be easily reconfigured for use in low-buoyancy fresh water or high-buoyancy salt water. Ideally, the personal watercraft will enable a stable mounting for a camera or a flag or other accessory item that affords convenient accessibility.

BRIEF SUMMARY OF THE INVENTION

An inflatable hand-held snorkeling float assembly comprises a see-through underwater viewing module. The viewing module has a top glass and a bottom glass joined together by a collapsible sidewall. A pneumatic chamber surrounds the viewing module. The chamber defines a central longitudinal axis and a central transverse axis. The chamber has a top deck and a spaced-apart bottom deck joined together by a bow and a stern and a port side and a starboard side. A starboard handle extends from the starboard side of the chamber. A port handle extends from the port side of the chamber. The top glass and the bottom glass are equally-angled away from one another relative to the central longitudinal axis. Similarly, the top deck and the bottom deck are equally-angled away from one another relative to the central longitudinal axis. The equal angular configurations provide flotation symmetry about the central longitudinal axis for roll-inverted usage while enabling flotation asymmetry about the central transverse axis for pitch-inverted usage in different buoyancy conditions.

The present invention enables the snorkeling float to be employed in any one of at least three (and possibly even four) holding orientations depending on the buoyancy enhancement needs of the user and/or the preferred placement of accessories either above or below the waterline. Because top and bottom glasses are equally-angled away from one another relative to the central longitudinal axis, and furthermore because the top and bottom decks are also equally-angled away from one another relative to the central longitudinal axis, the snorkeling float can be used with or without a personal flotation device (PFD) or flotation enhancements (e.g., wetsuit), as well as in both fresh and salt water settings. When certain optional accessories are provided, the snorkeling float can be deployed in locations that require dive flags or other identity markers, and with enhanced convenience for videography applications. When not in use, the snorkeling float can be deflated for conveniently carried storage and travel.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1:
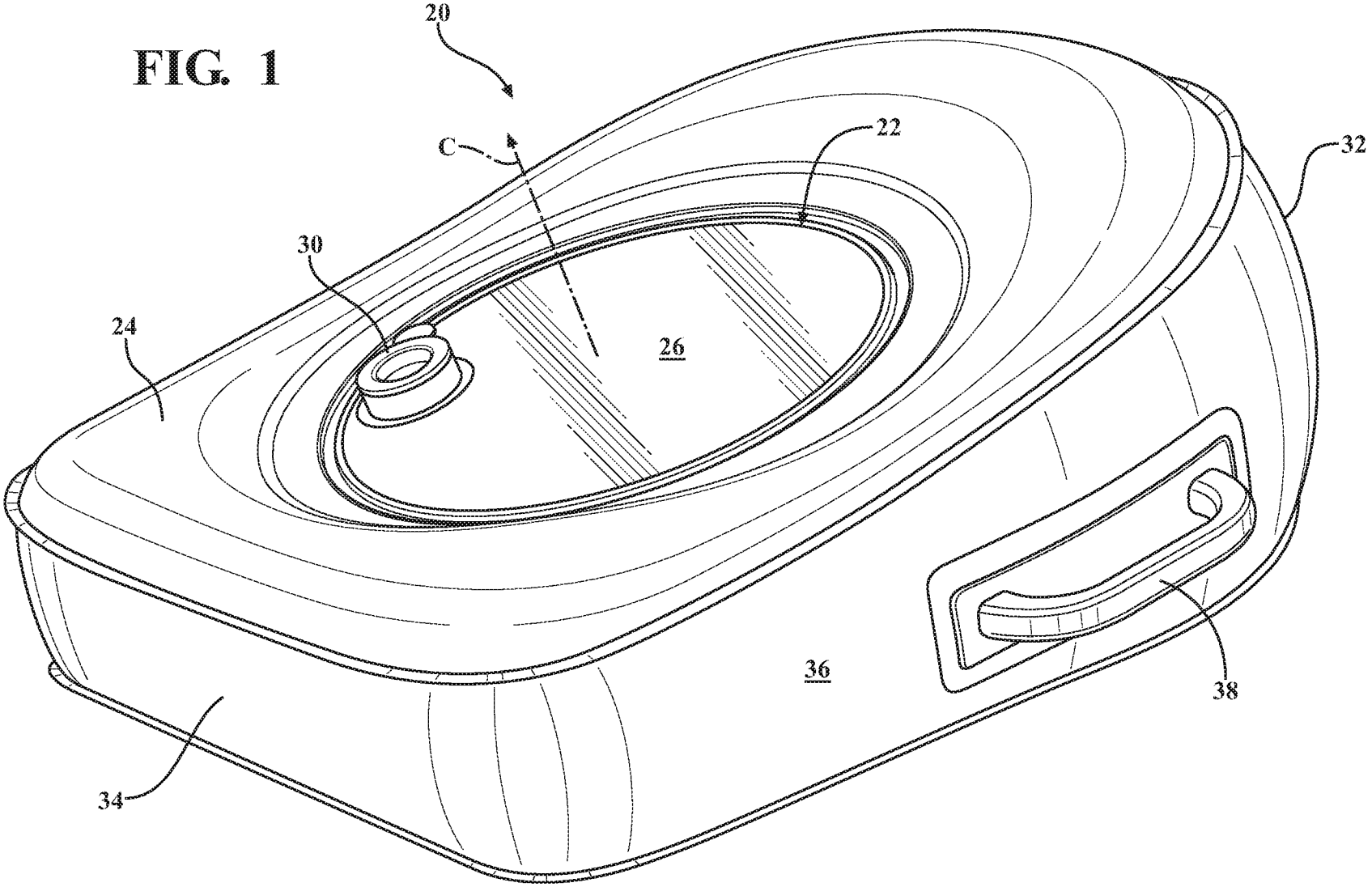
FIG. 1 is perspective view of a handheld inflatable snorkeling float underwater viewing window according to one exemplary embodiment of the present invention.

This invention provides underwater viewing capability integrated into a hand-held personal swim craft that can be deflated to a compacted state for convenient transport, that is robust, that is easy to maintain, and that will readily accommodate use in fresh and salt water for PFD-assisted users as well as non-PFD assisted users while orienting the viewing window so that it provides an optimal forward-looking field of view in all orientations and regardless of whether the user is wearing a PFD. The personal swim flotation craft, referred to herein as a snorkeling float, is generally shown at 20 in the accompanying illustrations. The snorkeling float 20 is designed to float on the water surface while being held between the outstretched hands of a user floating prone in a body of water. The snorkeling float 20 includes a see-through underwater viewing module 22 located so that the user can conveniently gaze through the viewing module 22 below the surface of the water. A pneumatic chamber 24 surrounds the viewing module 22. In the illustrated example, a single pneumatic chamber 24 is provided, however in other contemplated constructions multiple pneumatic chambers may be employed. Although a filling valve is not shown, it is contemplated that the chamber 24 is inflated and deflated through any suitable type of inflation valve.

The viewing module 22 is an inflatable cylinder designed to either be left empty/void or filled with water (e.g. sea water or fresh water) so that submerged features can be clearly observed from an above-surface vantage in a manner like that of the Harkrider '424 personal swim craft described above. The viewing module 22 of the present invention may have a generally circular shape as defined by a top glass 26 (FIG. 2) and a bottom glass 28 (FIG. 5) interconnected by a generally cylindrical sidewall. The cylindrical sidewall can be defined by a generally vertical axis or centerline C that can be easily located at the circular center of the top glass 26 in the top view of FIG. 2. In the illustrated examples, the cylindrical sidewall is designed to be collapsible. The circular top glass 26 and bottom glass 28 portions of the viewing module 22 are optically transparent, and preferably rigid. The transparent top glass 26 and bottom glass 28 may be specially formed of materials that have stain-free properties and/or self-cleaning coatings to reduce the tendency for stains and residual minerals to form after the water has been emptied. Visibility-enhancing modifications, such as polarization or filters, may be integrated into the glass plates 26, 28. Although referred to as "glass" it will be appreciated that the top glass 26 and bottom glass 28 will in most if not all cases be made from a durable polymer material.

The collapsible sidewall of the viewing module 22 that connects the spaced-apart top glass 26 and bottom glass 28 may be integrally formed by the surrounding chamber 24. When the chamber 24 is fully deflated, the viewing module 22 collapses so that the top glass 26 and bottom glass 28 may be brought substantially into surface-to-surface contact with one another. Alternatively, the viewing module 22 may be formed as a removable structure that fits into a complementary-shaped aperture in the chamber 24. In this latter example, the modular viewing module would also be collapsible. Collapsibility enables the snorkeling float 20 to be very compactly stored for travel, shipping and when not in use. However, when the chamber 24 is fully inflated, as shown throughout the Figures, the top glass 26 and bottom glass 28 are separated from one another by the internal air pressure.

Preferably, the chamber 24 is designed so that the top glass 26 and bottom glass 28 are symmetrically angled to one another in the fully inflated condition, creating a prismatic effect. That is, when viewed from the side as in FIG. 5, the viewing module 22 maintains a somewhat wedge-like shape. A prism angle (labeled $\lambda$ in FIG. 12) of the wedge-like viewing module 22 as measured in-between the top glass 26 and bottom glass 28 is between about 5° and 15°. That is, $5° \leq \lambda \leq 15°$. In preferred embodiments of the invention, the prism angle $\lambda$ between top 26 and bottom 28 glasses is between about 6° and 13°. Or, $6° \leq \lambda \leq 13°$. Ideal results have been achieved when the prism angle $\lambda$ in-between the top glass 26 and bottom glass 28 is between about 8° and 11°. I.e., $8° \leq \lambda \leq 11°$. One advantage of angling the top glass 26 and bottom glass 28 is that water splashed onto the float 20 will naturally drain off the viewing module 22 in use, even when the float 20 is inverted. Other advantages pertain to optical properties that will be described subsequently in connection with FIGS. 10-12.

Figure 5:
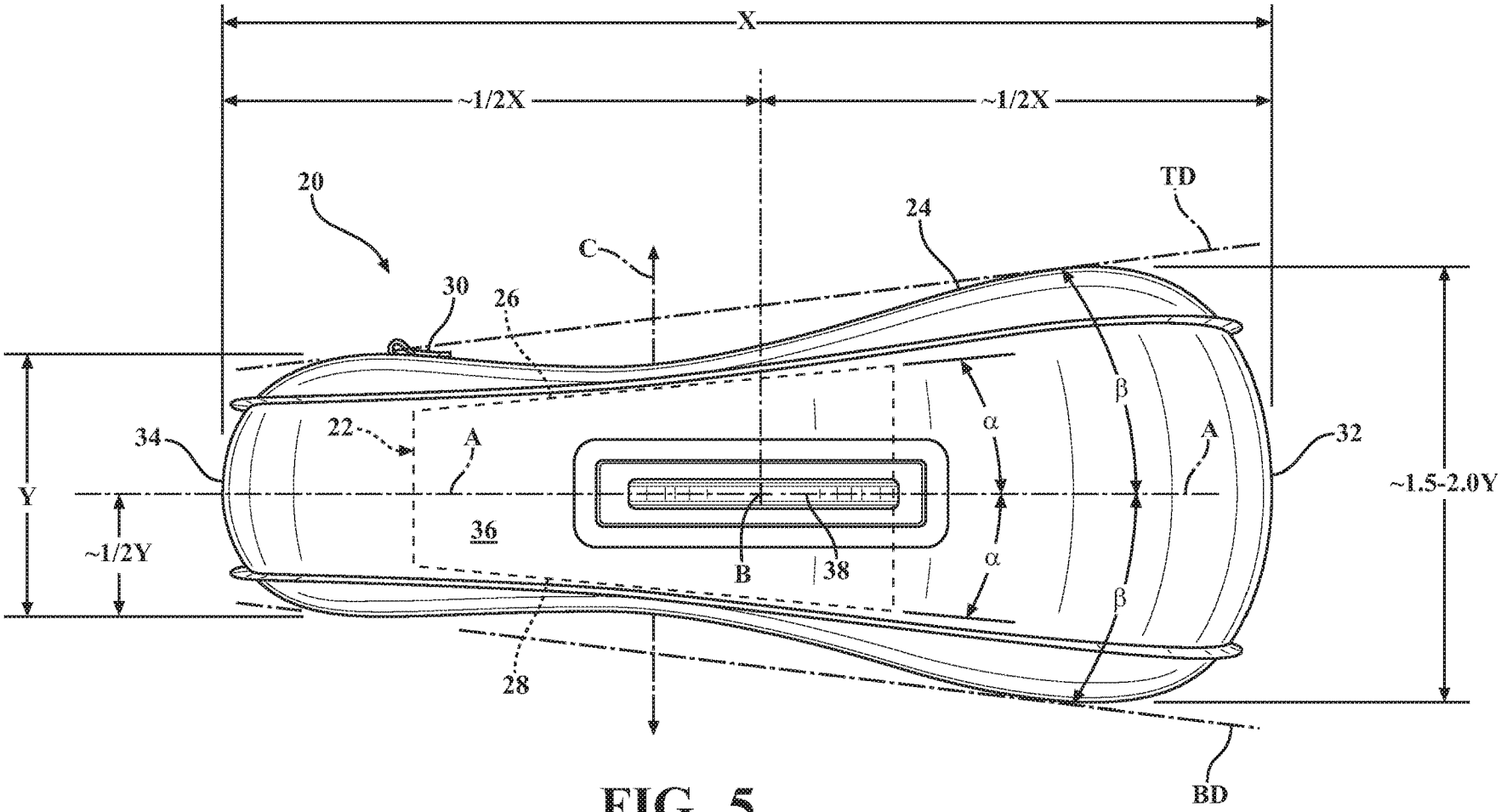
FIG. 5 is a side of the snorkeling float.
Figure 6:
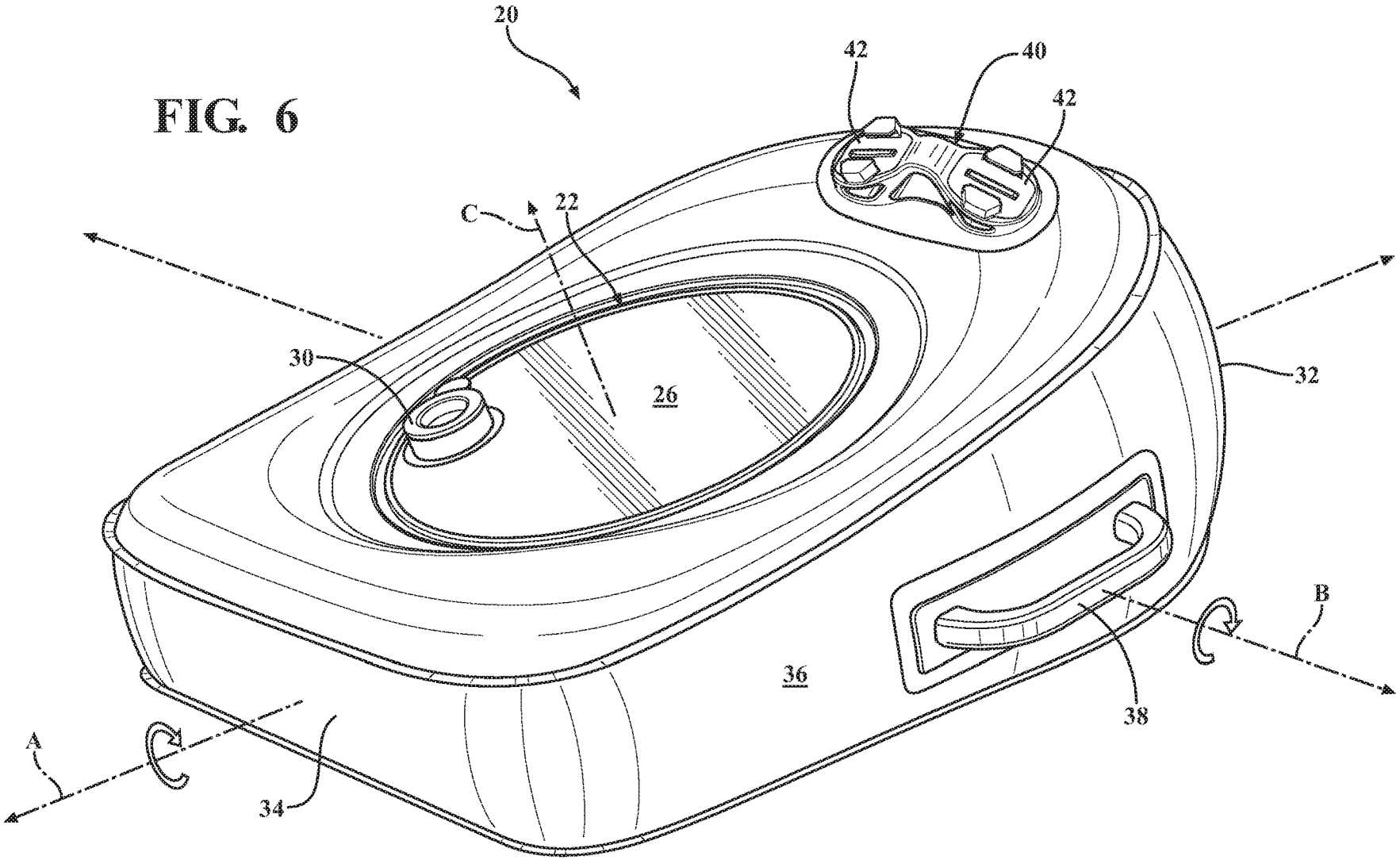
FIG. 6 is a perspective view as in FIG. 1 but showing imaginary axes of rotation as well as an optional accessory mount feature.

In terms of symmetry, FIG. 6 identifies natural axes of the snorkeling float 20. In particular, there is a central longitudinal axis A and a central transverse axis B. The axes A and B are oriented orthogonally to one another, and establish natural center lines in the horizontal plane. The chamber angle and also the prism angle $\lambda$ are bisected by the imaginary horizontal plane that contains both axes A and B. Or said another way, the top glass 26 and bottom glass 28 are equally-angled away from one another relative to the central longitudinal axis A. And likewise, the top and bottom decks are also equally-angled away from one another relative to the central longitudinal axis A. To emphasize this symmetry, the angles measured from the longitudinal centerline A and each of the top 26 and bottom 28 glasses is identified by the Greek letter $\alpha$ in FIG. 5. The prism angle $\lambda$ is thus equal to 2a. Expressed mathematically: $\lambda = 2\alpha$.

Figure 2:
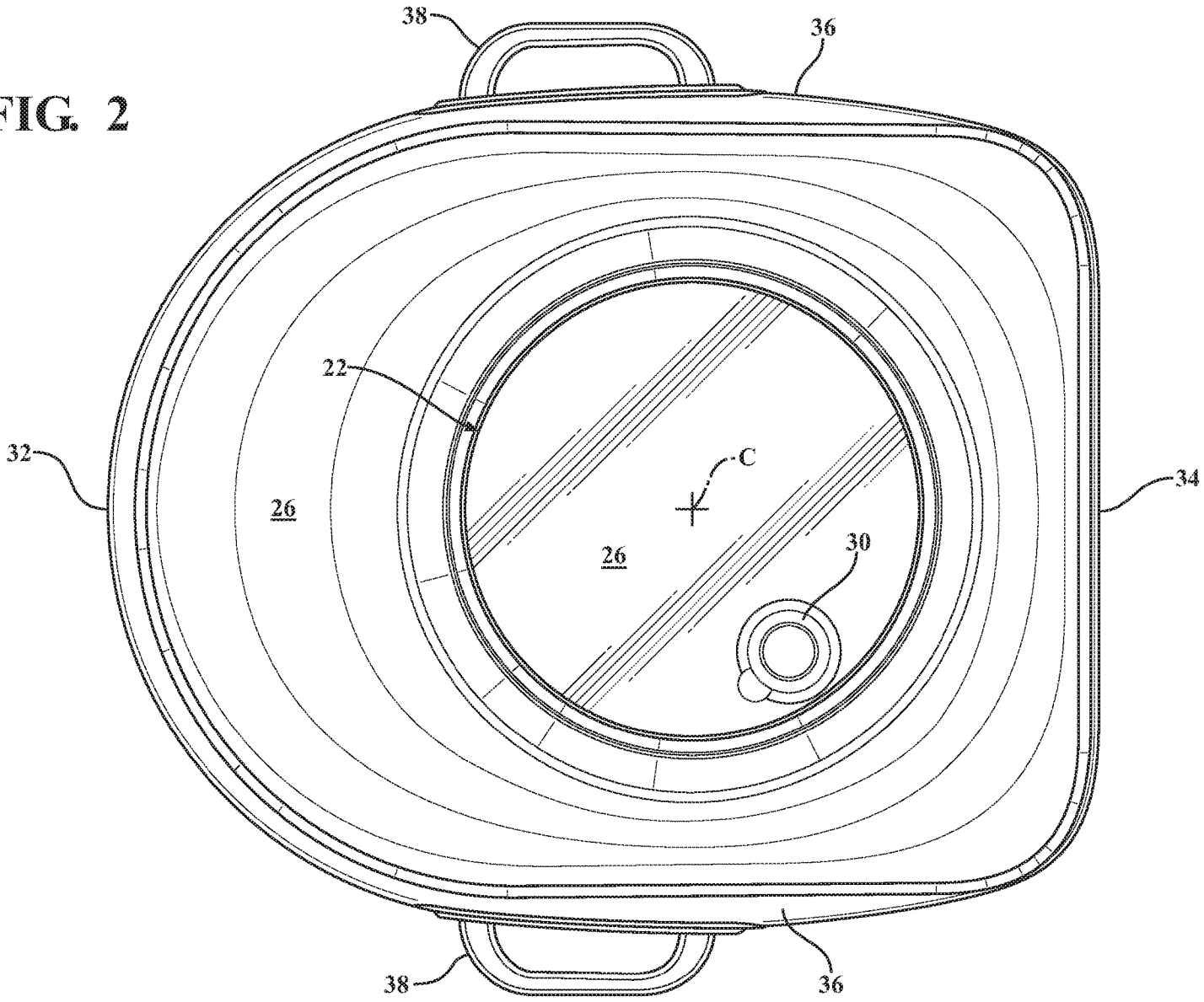
FIG. 2 is a top view of the snorkeling float.
Figure 3:
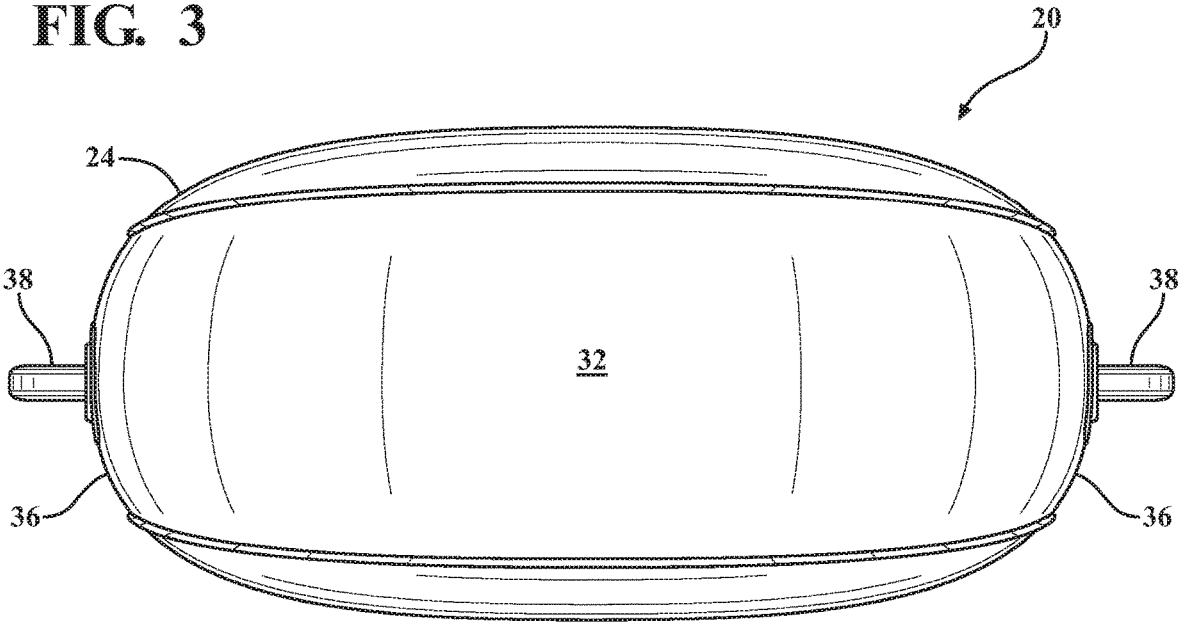
FIG. 3 is a front view of the snorkeling float.
Figure 4:
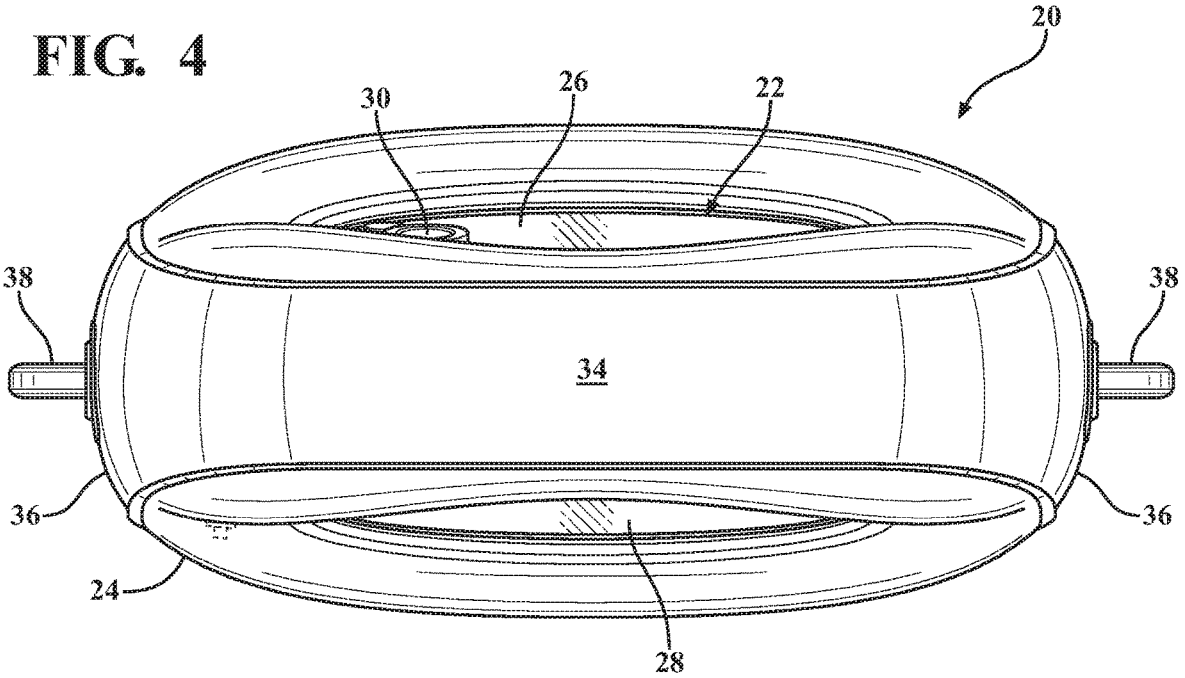
FIG. 4 is a rear view of the snorkeling float.

As mentioned above, the interior space inside the viewing module 22 can be left void (air filled) or in the alternative filled with water through a hole in the top glass 26 which is fitted with a re-sealable bung or plug 30 (FIGS. 1 and 2). Filling the void with water creates an advantageous magnification effect, but diminishes the overall buoyancy of the snorkeling float 20. Therefore, some users may decide that it is more desirable to fill the viewing chamber 22 with water when extra buoyancy is not required, such as when wearing a wetsuit or PFD, or when their body type is naturally buoyant, or perhaps in salt water applications. However, when the user would like enhanced buoyancy, the viewing chamber 22 should be left air-filled. This may be the case when the user is not wearing a wetsuit or PFD, when they are especially lean in build, or perhaps in fresh water applications.

When viewed from above, as in FIG. 2, the chamber 24 is seen to have a D-shaped outline defined by a rounded bow 32 and a generally straight stern 34. Sides 36 (port and starboard) are also generally straight in top view, with one handle 38 (port and starboard, respectively) protruding from each. The transverse axis B passes centrally through the handles 38. The port and starboard handles 38 are aligned with one another on opposite sides 36, generally mid-way between the tip of the bow 32 and the stern 34. FIG. 5 provides dimensional reference to this effect. If the overall length of the snorkeling float 20 is understood to be the measurement "X" then the midpoint location (axis B) of the handles 38 is approximately 0.5*X (i.e., half of X). In one illustrative example, the overall length of the float 20 is seventeen inches (17"), and the midpoint location (axis B) of the handles 38 is approximately eight-and-a-half inches (8½") from either end 32, 34. Naturally, some variation is possible and even expected, such that the actual range of the handle midpoints (axis B) may fall somewhere in the neighborhood of about 0.4X to about 0.6X without detracting significantly from the pitch-inverted functionally as will be described in more detail below. The generally vertical center-line C of the round viewing module 22 is generally aligned with the rear attachment points of each handle 38, as can be understood best in the plan view of FIG. 2. That is, the centerline C of the viewing module 22 is disposed between the central transverse axis B and the stern 34.

The pneumatic chamber 24 can be seen as presenting top and bottom decks, or surfaces, that are angled relative to one another in a wedge-like shape that generally coincides with the wedge shape of the viewing module 22. The top deck coincides with the top glass 26, whereas the bottom deck coincides with the bottom glass 28. As described above in connection with FIG. 5, the thickness or height of the chamber 24 adjacent the bow 32 is substantially greater than the thickness of the chamber 24 adjacent the stern 34, which in turn yields the pronounced wedge-like shape. The top and bottom decks are highly contoured. Nevertheless, if best-fit planes were established for each of the top and bottom decks, labeled TD and BD respectively in FIG. 5, the angle in-between (i.e., the included angle) could be designated as a chamber angle. Preferably, the longitudinal axis A provides a line of symmetry with respect to the planes of the top deck TD and bottom deck BD. To emphasize this symmetry, the angles measured from the longitudinal centerline A to each of the top TD and bottom BD decks is identified by the Greek letter β. The chamber angle mentioned above is thus 2β.

The chamber angle (2β) as measured in-between each plane TD-BD (i.e., between the decks) would be between about 5° and 15° in order to provide asymmetric buoyancy when inverted, as described below in connection with FIGS. 6-11. That is, $2.5° \leq \beta \leq 7.5°$. Less than about 5° does not provide enough discernable buoyancy difference when the float 20 is inverted, whereas greater than about 15° angle creates too much tilt and instability. In preferred embodiments of the invention, the chamber angle is between about 6° and 13°. That is, $3° \leq \beta \leq 6.5°$. Ideal results have been achieved when the chamber angle is between about 8° and 11°. Or, $4° \leq \beta \leq 5.5°$. In this manner, the upper and lower decks of the chamber 24 may be designed to coincide, at least generally, with the slope of the top glass 26 and bottom glass 28, respectively, when the snorkeling float 20 is fully inflated. I.e., the prism angle λ is generally equal to the chamber angle, and the top deck is generally parallel to the top glass 26 whereas the bottom deck is generally parallel to the bottom glass 28. If the thickness (i.e., height or minimum deck-to-deck measurement) of the chamber 24 adjacent the stern 34 is designated as the measurement "Y," then the thickness of the bow 32 (maximum deck-to-deck measurement) is preferably in the range of about 1.5Y to about 2.0Y. As an example, therefore, if the thickness of the fully-inflated chamber 24 adjacent the stern 34 is 3.75 inches, the thickness of the chamber 24 adjacent the bow 32 will range between about 5.625 and 7.5 inches. Superior results have been achieved when the bow 32 thickness is between about 1.7 and 1.8 times the stern 34 thickness.

Thus, the angles α, β of the glasses 26, 28 and decks TD, BD are all about the same measures (i.e., $\alpha \approx \beta$) thus producing an isosceles trapezoid with a line of symmetry about the longitudinal axis A. Because of this symmetry, the flotation characteristics of the snorkeling float 20 are substantially identical whether floating with bottom deck wet or top deck wet in roll-inverted scenarios. However, in pitch-inverted scenarios, the flotation characteristics are beneficially asymmetric. The snorkeling float 20 also may possess symmetry about a vertical plane containing the central longitudinal axis A but perpendicularly intersecting the central transverse axis B.

FIGS. 6-11 depict the snorkeling float 20 with an optional multi-function accessory mount, generally indicted at 40, affixed at or near the highest mound area on the top deck surface. The accessory mount 40 supports at least one, but preferably two, dedicated connection pads in the form of a pronged clip compatible with a GoPro® universal mount. Anything that could be clipped into a GoPro® style mount could also be clipped onto either pad. The accessory mount 40 provides an ideal perch for securing a video camera or a dry box or an illumination device or a GPS device or a smart phone or a dive flag or any other accessory compatible with the mounting configuration. A centrally-located, generally triangular, main opening is provided between the two pads for easy gripping and easy threading of a rope or carabiner clip, as shown in FIG. 12. Ancillary openings are disposed underneath each pad to offer additional points with which to tie a rope, reduce weight and/or provide a degree of shock-absorbing resiliency to attached devices.

Figure 7:
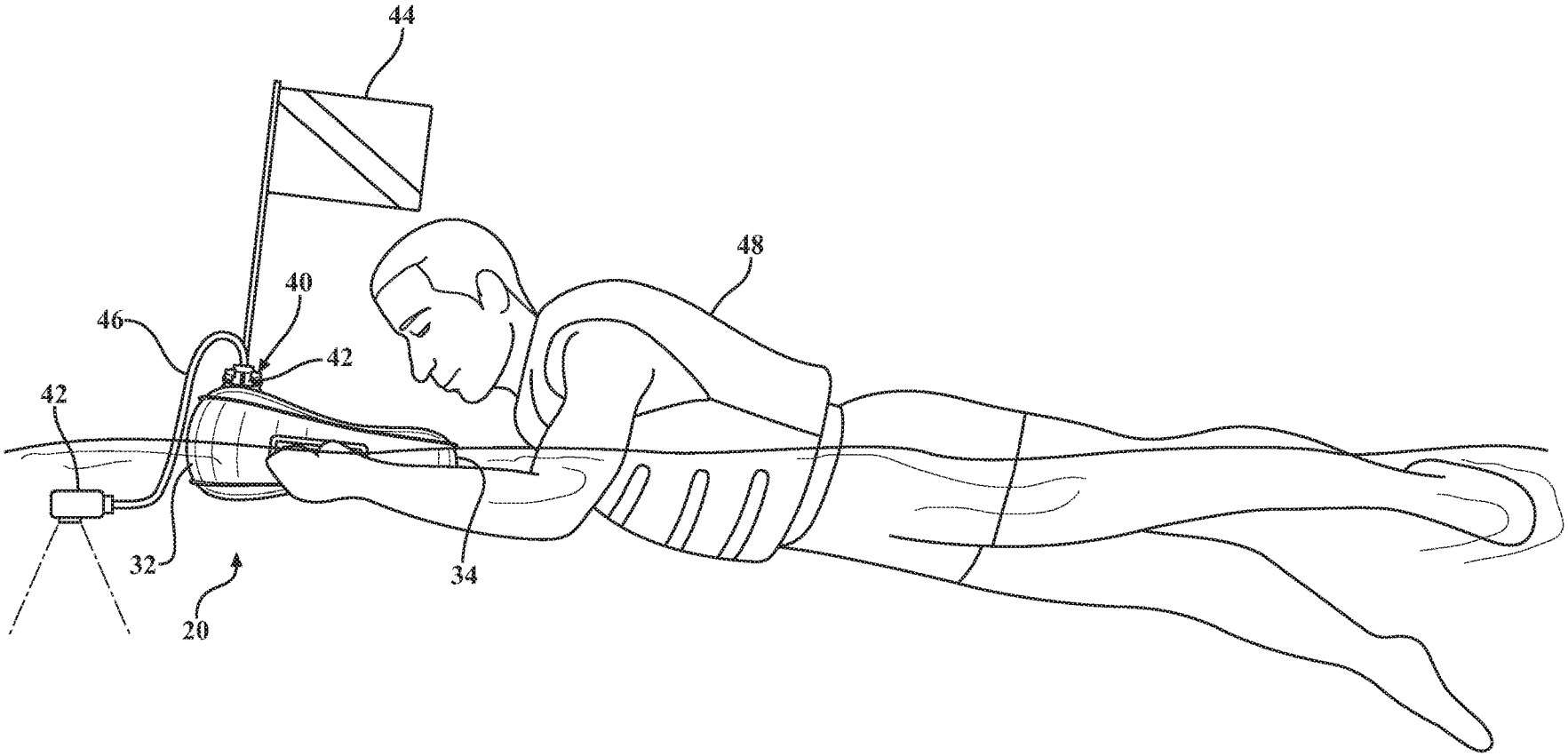
FIG. 7 is simplified view showing the snorkeling float in a primary holding orientation where the optional accessory mount is positioned on the top (above water) side of the device.

U.S. Design Pat. No., issued Dec. 19, 2017, shows one exemplary embodiment of an accessory mount 40 suitable for use in conjunction with this invention. The entire disclosure of D805,597 is hereby incorporated by reference. Each accessory mount 40 allows the user to install up to two amphibious cameras or other accessory features 42. Many consumers already own multiple camera set-ups that will install easily as accessories 42 to the accessory mount 40. In one contemplated application, the accessory 42 comprises a sealed container in the form of a camera housing of the type used to store a Go-Pro® camera. Naturally, the accessory 42 could be light or something different, or perhaps a dive flag 44 (FIG. 7). Also, a flexible arm 46 (FIGS. 7-9) could be used to achieve a high degree of placement flexibility for the accessory 42.

In one possible configuration, the flexible arm 46 could take the form of a gooseneck flex mount extension with a positional-range exceeding 180° that also allows camera rotation and even positioning below the waterline (e.g., FIG. 7). The flexible extension 46 is adjustable in length by adding or removing the desired number of section segments. A standard ¼" 20 UNC tripod/monopod mount adapter may be included for using common camera attachment techniques. A safety leash and carabiner may be included to secure the supported accessory.

Figure 8:
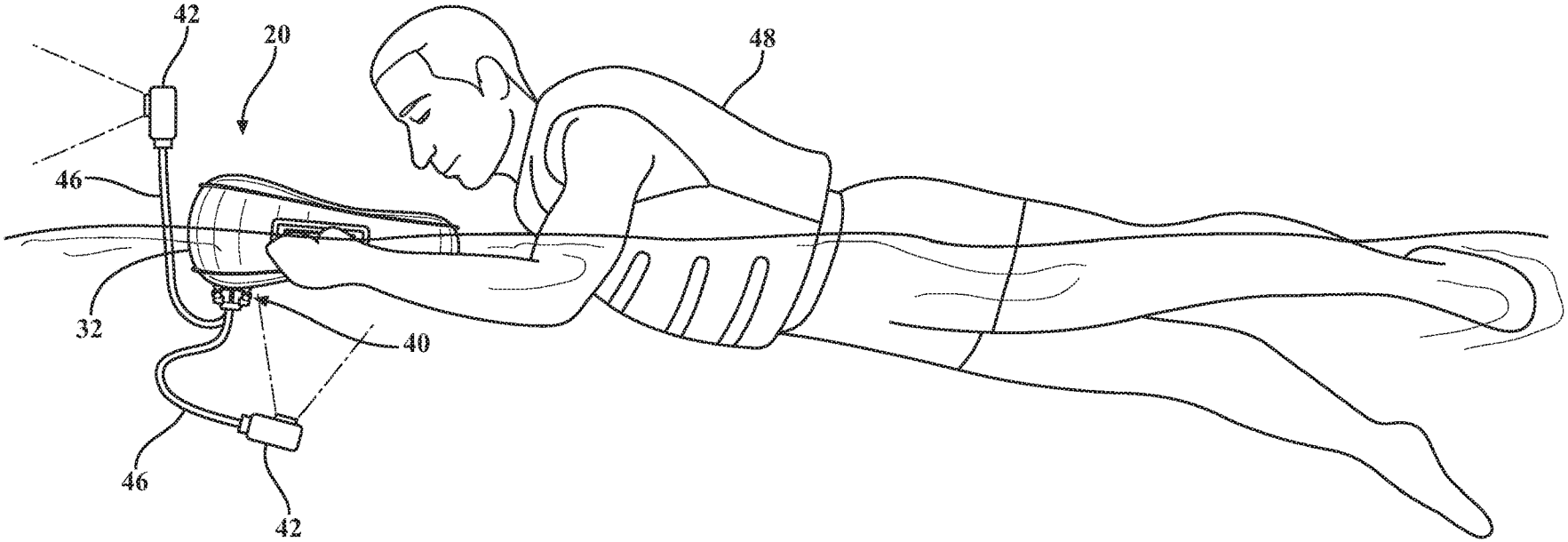
FIG. 8 is a view as in FIG. 7 but showing the snorkeling float in the roll-inverted secondary holding orientation so that that the optional accessory mount is positioned underwater.
Figure 9:
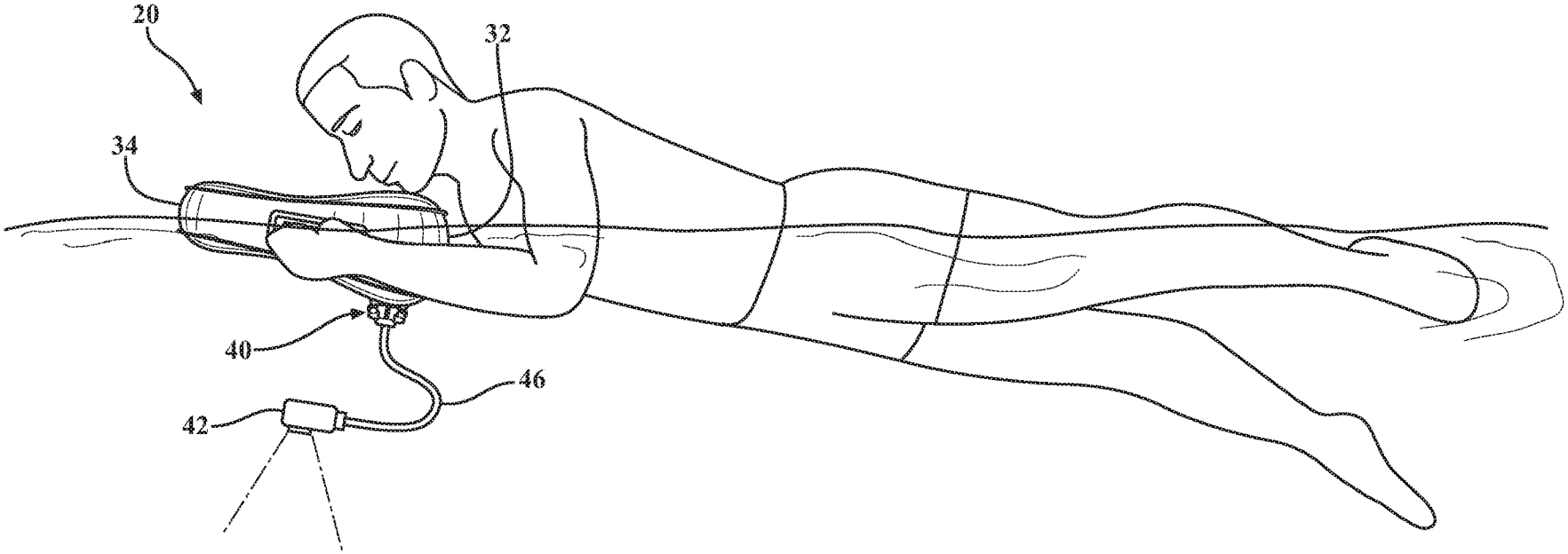
FIG. 9 is simplified view showing the snorkeling float in the pitch-inverted tertiary holding orientation for use by a person that is not wearing a PFD or who otherwise requires maximum buoyancy assist.

In use, the snorkeling float 20 has at least three primary holding orientations represented, respectively, in FIGS. 7-9. The first, or primary, holding orientation is shown in FIG. 7, and is distinguished by the bow 32 forward and the accessory mount 40 above water-line. The bottom deck is submerged in this primary holding orientation. The second, or secondary, holding orientation (FIG. 8) is achieved by roll-inverting the snorkeling float 20 about the longitudinal axis A. In this secondary orientation, the bow 32 remains pointing forward but the accessory mount 40 is now submerged below the water-line. The top deck is submerged in this secondary holding orientation. The third, or tertiary, holding orientation (FIG. 9) is achieved by pitch-inverting the snorkeling float 20 from the primary orientation (of FIG.

7) about the transverse axis B. In this tertiary orientation, the bow 32 is located rearwardly, toward the user, and the accessory mount 40 is submerged below the water-line. The top deck is also submerged in this tertiary holding orientation. Thus, the snorkeling float 20 is both roll-invertible (about axis A) and pitch-invertible (above axis B) to achieve three distinctly different holding orientations, each suited to a different set of use conditions. In all three holding orientations, the head of a user floating prone in the water is conveniently positioned above the viewing module 22 so as to provide clear underwater observation with minimal reflections or distortions.

Each of the orientations will be described in further detail below, beginning with the primary holding orientation of FIG. 7. As stated earlier, the primary holding orientation is distinguished by the bow 32 pointing forward and the accessory mount 40 on top (above water-line). This orientation is most conducive to the attachment of a dive flag 44 to one of the pads on the accessory mount 40. The user, laying prone in the water, has both arms partially extended and comfortably grips the handles 38. The user may, if desired, rest their chin on the relatively thin stern 34 portion of the float 20. The primary holding orientation is particularly conducive in settings where the user's natural or augmented buoyancy tends to allow their body to ride high in the water line, thus very comfortably positioning their chin relative to the exposed surface of the stern 34. If the user is very lean, and/or if the setting is fresh water, the user may need to increase their buoyancy by wearing a PFD (personal flotation device) 48, wetsuit or other buoyancy enhancing device.

In this primary holding orientation, the user is able to gently increase their own positive buoyancy by resting their chin on the stern 34, in conjunction with placing hands aside the craft 20 on the handles 38. The thicker dimension of the bow 32 combined with the user's chin at rest on the stern 34, imparts a backwardly angled slant or tilt to the top glass 26 which is inviting for underwater observation through the viewing module 22. The top glass 26 of the viewing module 22 does not submerge, which would otherwise negatively impact visual performance by adding a layer of water atop the window glass 26.

The user may add accessories 42 including camera(s), a dive flag 44 (required in some jurisdictions), and other devices as may be desirable. This is the only holding orientation that allows the user to mount a marking flag 44 upward while using a flexible mount extension 46 curled downwards to also have a submerged camera 42 (or to have a second camera above the waterline instead of a marker flag 44).

The secondary holding orientation is depicted in FIG. 8, wherein the user's chin remains either held above or else at rest upon the thin stern 34 portion, in conjunction with hands grasping the handles 38. It should be noted that a person's neck is susceptible to easily tire of being held up while floating prone in the water, such that having the ability to rest one's chin on the float 20 is a distinct advantage enabling longer periods of use. The user is buoyed by the float 20 at three points of contact: through his/her chin and through each hand. This, therefore, creates for the user a stable tripod-like support strategy formed by hands on two widely-spread, centrally-located, handles 38 and a chin at rest on the centerline of the deck of the float 20. These evenly-distributed three-points of contact produce stability and allocate the downward pressure (primarily weight force) thus giving the user a distinct sense of reliable buoyancy.

As in FIG. 14, if the user is very lean, and/or in fresh water settings, the user may need to increase their buoyancy by wearing a PFD 48. In this secondary holding orientation, the snorkeling float 20 has been roll-inverted by a 180° rotation about its longitudinal axis A. The bow 32 is pointing forward and the accessory mount 40 is now below the water line. This allows accessories 42 to be mounted underwater, such as an amphibious camera, so that the user may view and control the camera while observing through the top 26 and bottom 28 glasses of the viewing module 22. That is to say, with or without the aid of a flexible arm 46, the second holding orientation enables a user to maintain visual contact with a submerged accessory 42 attached to the accessory mount 40. This secondary holding orientation also enables many advantageous videography options. For example, one camera 42 could be positioned underwater (with or without the aid of a flexible arm 46) and another camera 42 above water by using a flexible mount extension 46 that curls the above water camera to the side or in front of the float 20.

In cases where the optional accessory mount 40 is omitted, the primary and secondary holding orientations are essential identical. And furthermore, the tertiary holding orientation also becomes "roll-invertible". In this scenario, the user may roll-invert the float 20 without concern for which direction is "up," as the snorkeling float 20 will function exactly the same in either bow 32 forward condition or in either stern 34 forward condition. Thus, when the optional accessory mount 40 is omitted, the snorkeling float 20 becomes somewhat easier to use in that the specific holding orientation is as simple paying attention to whether the bow 32 is pointing forward or the stern 34 is pointing forward.

From the primary holding orientation, the user may roll-invert the float 20 about its transverse axis B to the tertiary holding orientation depicted in FIG. 9. Here, the user's chin is poised to rest upon the thick bow 32 portion, again in conjunction with hands grasping the handles 38. A substantially greater amount of water will be displaced by the snorkeling float 20 in this tertiary holding orientation because of the enlarged bow 32. As a result, the buoyancy force imparted to the user through the aforementioned three points (chin and both hands) will be greater, so that this tertiary holding orientation may be preferred in settings where more buoyancy is required. (Buoyancy will be greatest if the viewing module 22 is filled with air.) If the user is not wearing a PDF 48 or wetsuit, or perhaps has a very lean build, added buoyancy may be needed to maintain the user's head/chin in a comfortable viewing position far enough above the waterline to still view down and through the viewing module 22. As with the secondary holding orientation (FIG. 8), the tertiary holding orientation also enables a user to maintain visual contact through the viewing module 22 with a submerged accessory 42 attached to the accessory mount 40.

A possible fourth holding orientation is contemplated wherein the stern 34 is pointing forward and the accessory mount 40 is above water-line. This fourth holding orientation is not illustrated, but can be understood by roll-inverting the snorkeling float 20 from the tertiary orientation (of FIG. 9) about the longitudinal axis A. A specially-designed chin-cup could be fashioned to attach to the accessory mount 40. In this configuration, a user may desire, or because of physical limitations require, their head to be precision-supported above the thick and extra-buoyant bow 32. The chin cup would thus be effective to hold the person's head at an optimal elevated orientation above the bow 34.

Figure 10:
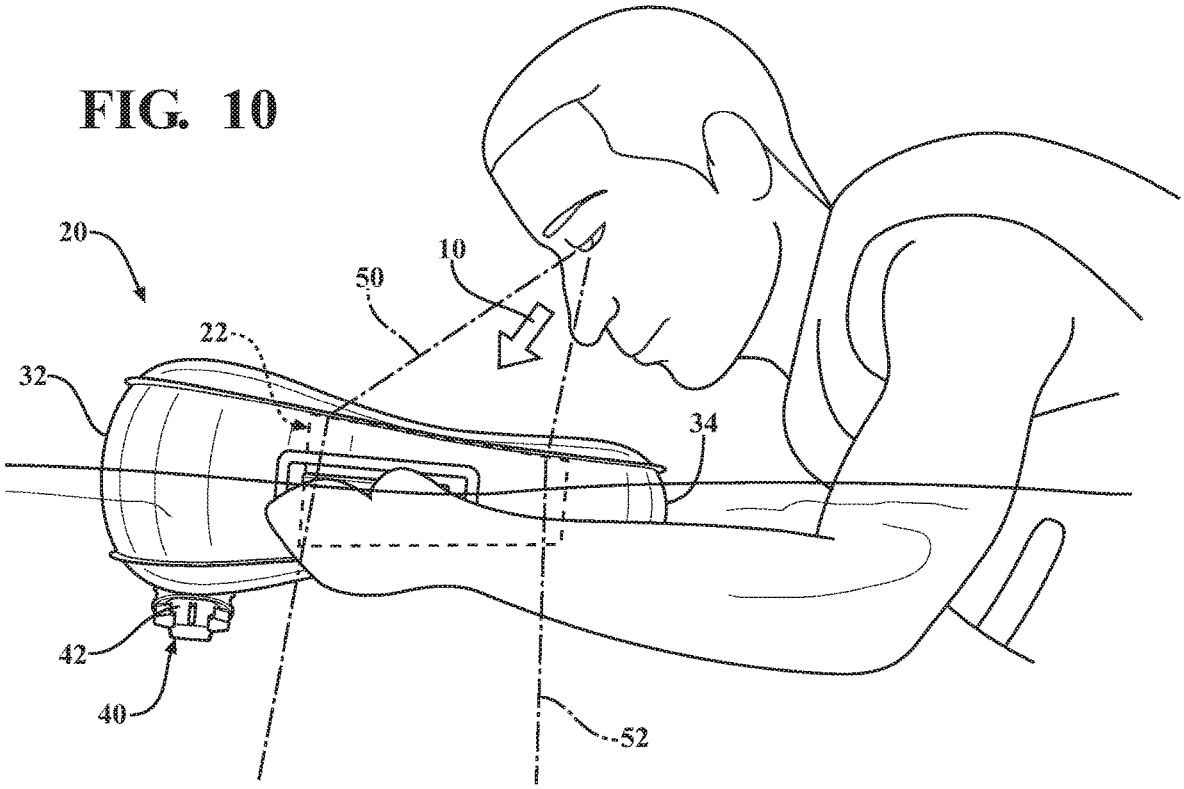
FIG. 10 is an enlarged view of the snorkeling float as depicted in FIG. 8 and showing the forward-looking field of view presented through the viewing window when the float is in either the primary holding orientation or the roll-inverted secondary holding orientation of FIG. 7 or 8.

FIG. 10 is an enlarged view of a snorkeling float 20 taken from FIG. 8 in which the viewing module 22 is in the roll-inverted secondary holding orientation. In both this condition and in the primary holding orientation of FIG. 7, the bow 32 is pointing away from the user. Thus, FIG. 10 is representative of both the primary and secondary holding orientations. This FIG. 10 orientation is characterized by the large/thick end of the wedge-shaped viewing module 22 farthest from the eyes of the user. The prismatic effects of the viewing module 22 in this orientation are depicted by broken lines corresponding to the user's natural field-of-view from his or her perspective as indicated by directional arrow 10. The portion of the user's field-of-view above viewing module 22 (i.e., in air) is referred to as the natural FOV 50. The portion of the user's field-of-view below viewing module 22 (i.e., under water) is referred to as the projected FOV 52.

Because the snorkeling float 20 is held in front of the prone floating user, a forward-looking natural FOV 50 is assumed in the mind of the user. By correlating the user's natural FOV 50 with the projected FOV 52 that is underwater in the same forward-looking direction, the user will have a greater sense of control and reduced disorientation effects that sometimes occur with novice users. The prismatic viewing module 22 projects the user's vision in a forward-looking direction, albeit slightly magnified due to the optical effects created by the wedge-shape. Thus, the user will intuitively understand that the images visible through the viewing module 22 represent underwater images in the advancing direction. In other words, the shape and orientation of the viewing module 22 allow the user to see what is front of them just as they would normally expect when looking through air. The refraction effects depicted in FIGS. 10-12 assume a water-filled viewing module 22. Similar but non-magnified field-of-view projections are achieved when the viewing module 22 is air-filled. In addition to the beneficial forward-looking projected FOV 52, the top glass 26 is maintained at a backwardly-canted slope in both the primary and secondary holding orientations, thereby automatically shedding any water that is splashed onto the viewing module 22. In this manner, the top glass 26 self-drains so that the user always has a good-quality view underwater in a forward-looking direction. The coordinated prism angle $\lambda$ (or, $2\alpha$) and chamber angle ($2\beta$) enable the beneficial effects described above.

Figure 11:
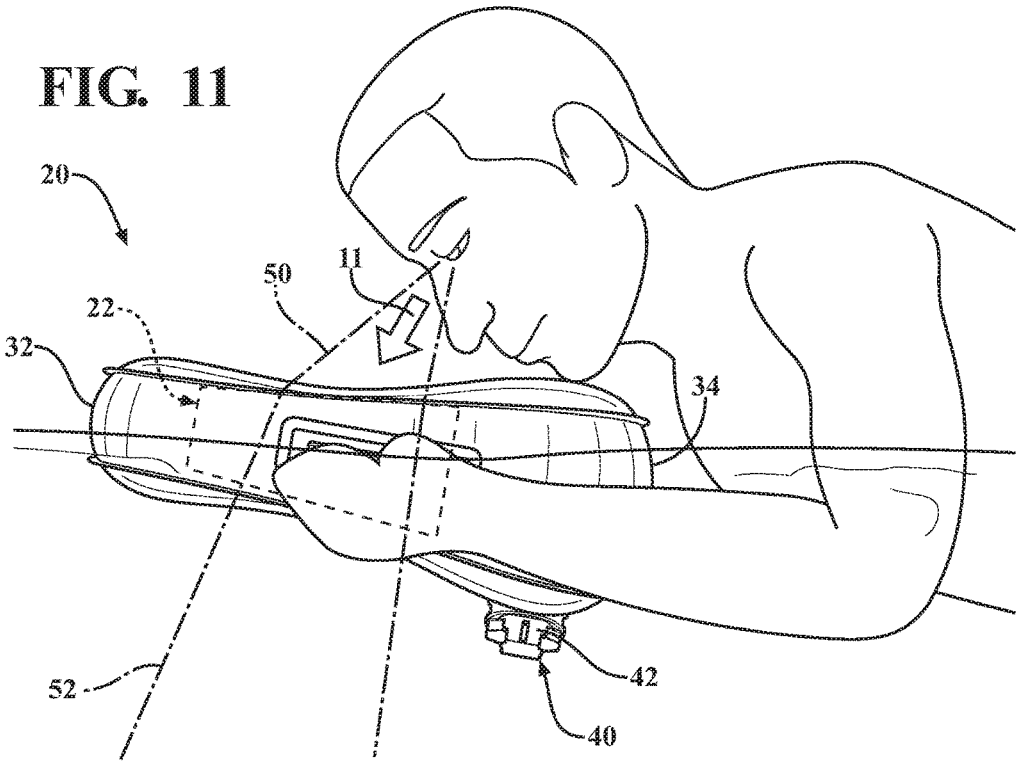
FIG. 11 is an enlarged view of the snorkeling float when held in the tertiary pitch-inverted holding orientation of FIG. 9 also showing the forward-looking field of view presented through the viewing window.
Figure 12:
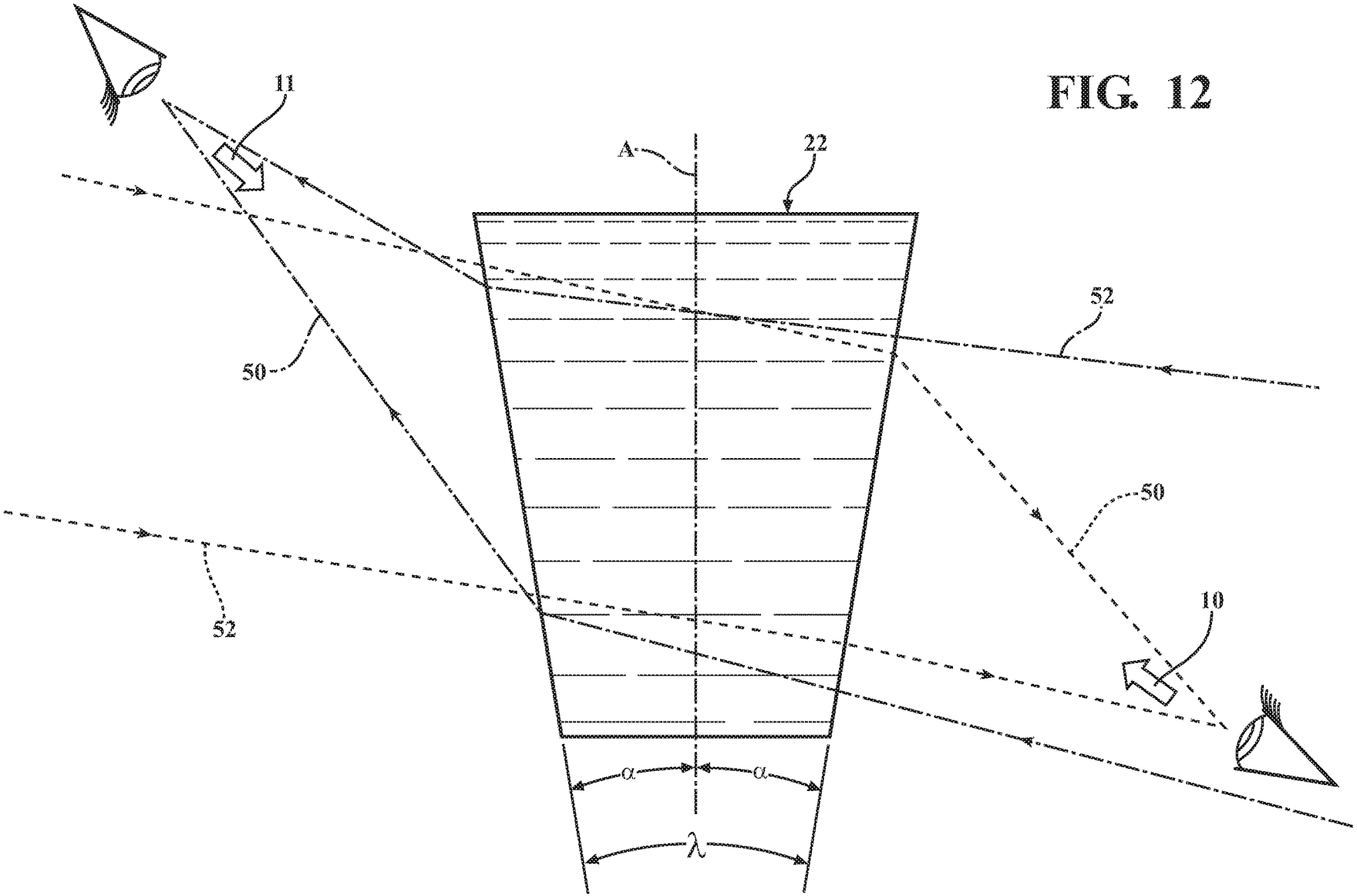
FIG. 12 is a schematic view depicting the manner in which the user's vision is refracted through the viewing module like a prism with superimposed viewing angles for the primary/secondary and tertiary holding orientations of the snorkeling float.

FIG. 11 is an enlarged view of a snorkeling float 20 taken from FIG. 9 in which the viewing module 22 is in the pitch-inverted tertiary holding orientation. In this condition, the stern 34 is pointing away from the user, and the small end of the wedge-shaped viewing module 22 farthest from the eyes of the user. The prismatic effects of the viewing module 22 in this orientation are similarly depicted with broken lines corresponding to the user's natural FOV 50 from his or her perspective as indicated by directional arrow 11. The portion of the user's field-of-view below viewing module 22 (i.e., under water) is also identified as the projected FOV 52. As in all orientations, the snorkeling float 20 is held in front of the prone floating user, with a forward-looking natural FOV 50 assumed in the mind of the user. Even in this tertiary pitch-inverted holding orientation, the prismatic viewing module 22 continues to project the user's vision in a forward-looking direction so that they can see what is front of them underwater. In this orientation, the bottom glass 28 is above the water-line and exposed to the user's natural FOV 52. Note that in this pitch-inverted tertiary holding orientation, the bottom glass 28 is maintained at a backwardly-canted slope, thereby automatically shedding any water that is splashed onto the viewing module 22. Thus, in all holding orientations (primary, secondary and tertiary), the viewing module 22 self-drains so that the user always has a good-quality view underwater in a forward-looking direction. This is a product of the matched prism angle $\lambda$ (or, $2\alpha$) and chamber angle ($2\beta$).

FIG. 12 is presented to emphasize the optical properties of the prism-like viewing module 22. Direction arrows 10 & 11 correspond to the user perspectives of FIGS. 10 and 11, respectively. For each perspective 10, 11, the natural FOV 50 is shown entering a water-filled viewing module 22. The light that represents the user's natural FOV 50 refracts upon encountering the water inside the viewing module 22. Little-to-no optical refraction is expected when the light exits the viewing module 22 and continues underwater as the projected FOV 52. (As described above, the net optical effect remains substantially the same with an air-filled viewing module 22 but without magnification.) The wedge-shape of the chamber 24, combined with the wedge-shape of the viewing module 22, in symmetrical union, enable the user's perspective 10, 11 to maintain a forward-looking projected FOV 52 regardless of whether the snorkeling float 20 is held in the primary, roll-inverted secondary or pitch-inverted tertiary orientation. Furthermore, the viewing module 22 naturally sheds water in any of these holding orientations to maintain viewing quality.

It will therefore be appreciated that the snorkeling float 20 may be employed in any one of three (primary, secondary, tertiary) holding orientations depending on the buoyancy enhancement needs of the user and/or the preferred placement of accessories 42, 44 either above or below the waterline. Because top and bottom glasses 26, 28 are equally-angled ($\alpha$) away from one another relative to the central longitudinal axis A, and furthermore because the top and bottom decks (as represented by best fit planes TD, BD) are also equally-angled ($\beta$) away from one another relative to the central longitudinal axis A, a flotation symmetry (i.e., symmetry of buoyancy with respect to the user) results for roll-inverted usage. However, because of the wedge-like (or more particularly the isosceles trapezoid) shape of the chamber 24, flotation asymmetry (i.e., asymmetry of buoyancy with respect to the user) results about the central transverse axis B for pitch-inverted usage in different buoyancy conditions. As a result, the snorkeling float 20 can be used in both fresh and salt water settings, with or without a personal flotation device (PFD), in locations that require dive flags 44 or other identity markers, and with enhanced convenience for videography applications. When not in use, the snorkeling float 20 can be deflated for conveniently carried storage and travel.

The foregoing invention has been described in accordance with the relevant legal standards, thus the description is exemplary rather than limiting in nature. Variations and modifications to the disclosed embodiment may become apparent to those skilled in the art and fall within the scope of the invention. Furthermore, particular features of one embodiment can replace corresponding features in another embodiment or can supplement other embodiments unless otherwise indicated by the drawings or this specification.

What is claimed is:

1. An inflatable hand-held snorkeling float assembly comprising:

a see-through underwater viewing module, said underwater viewing module having a top glass and a bottom glass joined together by a collapsible sidewall, a pneumatic chamber surrounding said viewing module, said chamber defining a central longitudinal axis and a central transverse axis, said chamber having a top deck and a spaced-apart bottom deck joined together by a bow and a stern and a port side and a starboard side, a starboard handle extending from said starboard side of said chamber, a port handle extending from said port side of said chamber, and wherein said top glass and said bottom glass are equally-angled away from one another relative to said central longitudinal axis, and said top deck and said bottom deck are equally-angled away from one another relative to said central longitudinal axis thereby providing flotation symmetry about the central longitudinal axis for roll-inverted usage and flotation asymmetry about the central transverse axis for pitch-inverted usage.

2. The assembly of claim 1 wherein said top deck is generally parallel to said top glass and said bottom deck is generally parallel to said bottom glass.

3. The assembly of claim 1 wherein the angle between said top glass and said bottom glass is defined as a prism angle, said prism angle is between about 5° and 15°.

4. The assembly of claim 1 wherein the angle between said top glass and said bottom glass is defined as a prism angle, said prism angle is between about 6° and 13°.

5. The assembly of claim 1 wherein the angle between said top glass and said bottom glass is defined as a prism angle, said prism angle is between about 8° and 11°.

6. The assembly of claim 1 wherein the angle between said top deck and said bottom deck is defined as a chamber angle, said chamber angle is between about 5° and 15°.

7. The assembly of claim 1 wherein the angle between said top deck and said bottom deck is defined as a chamber angle, said chamber angle is between about 6° and 13°.

8. The assembly of claim 1 wherein the angle between said top deck and said bottom deck is defined as a chamber angle, said chamber angle is between about 8° and 11°.

9. The assembly of claim 1 wherein said collapsible sidewall is generally cylindrical.

10. The assembly of claim 1 wherein said bow has a height and said stern has a height, said bow height being approximately 1.5 to 2.0 times greater than said stern height.

11. The assembly of claim 1 further including an accessory mount affixed to one of said top and bottom decks adjacent said bow.

12. An inflatable hand-held snorkeling float assembly comprising:

a see-through underwater viewing module, said underwater viewing module having a top glass and a bottom glass joined together by a collapsible sidewall, said sidewall being generally cylindrical as defined by a generally vertical centerline, a pneumatic chamber surrounding said viewing module, said chamber defining a central longitudinal axis and a central transverse axis, said chamber having a top deck and a spaced-apart bottom deck joined together by a bow and a stern and a port side and a starboard side, a starboard handle extending from said starboard side of said chamber, a port handle extending from said port side of said chamber, said starboard and port handles being generally centered along said central transverse axis, said vertical centerline of said sidewall being disposed between said central transverse axis and said stern, and wherein said top glass and said bottom glass are equally-angled away from one another relative to said central longitudinal axis, and said top deck and said bottom deck are equally-angled away from one another relative to said central longitudinal axis thereby providing flotation symmetry about the central longitudinal axis for roll-inverted usage and flotation asymmetry about the central transverse axis for pitch-inverted usage.

13. The assembly of claim 12 wherein said top deck is generally parallel to said top glass and said bottom deck is generally parallel to said bottom glass.

14. The assembly of claim 12 wherein the angle between said top glass and said bottom glass is defined as a prism angle, and wherein the angle between said top deck and said bottom deck is defined as a chamber angle, said prism angle and said chamber angle are each between about 5° and 15°.

15. The assembly of claim 12 wherein the angle between said top glass and said bottom glass is defined as a prism angle, and wherein the angle between said top deck and said bottom deck is defined as a chamber angle, said prism angle and said chamber angle are each between about 6° and 13°.

16. The assembly of claim 12 wherein the angle between said top glass and said bottom glass is defined as a prism angle, and wherein the angle between said top deck and said bottom deck is defined as a chamber angle, said prism angle and said chamber angle are each between about 8° and 11°.

17. The assembly of claim 12 wherein said bow has a height and said stern has a height, said bow height being approximately 1.5 to 2.0 times greater than said stern height.

18. The assembly of claim 12 further including an accessory mount affixed to one of said top and bottom decks adjacent said bow.

19. An inflatable hand-held snorkeling float assembly comprising:

a see-through underwater viewing module, said underwater viewing module including a top glass and a bottom glass joined together by a collapsible sidewall, said collapsible sidewall being generally cylindrical as defined by a generally vertical centerline, said top glass and said bottom glass being fabricated from a rigid and optically transparent material, a re-sealable fill plug disposed in one of said top and bottom glasses, said top glass and said bottom glass being angled relative to one another at a predetermined prism angle between about 5° and 15°, a pneumatic chamber surrounding said viewing module, said chamber having a top deck and a spaced-apart bottom deck joined together by a bow and a stern and a port side and a starboard side, said bow having a height and said stern having a height, said bow height being approximately 1.5 to 2 times greater than said stern height, said bow having a generally rounded profile, said top deck being generally parallel to said top glass and said bottom deck being generally parallel to said bottom glass, said top deck being skewed relative to said bottom deck at a chamber angle between about 5° and 15°, a starboard handle extending from said starboard side of said chamber, a port handle extending from said port side of said chamber, each of said port and starboard handles being generally centered between said bow and said stern, said starboard and port handles being generally centered along said central transverse axis, and said vertical centerline of said sidewall being disposed between said central transverse axis and said stern.

20. The assembly of claim 19, further including an accessory mount affixed to one of said top and bottom decks adjacent said bow, said accessory mount having a pair of dedicated connection pads.

* * * * *